United States Patent [19]

Wirz et al.

[11] Patent Number: 4,869,489

[45] Date of Patent: Sep. 26, 1989

[54] SUCTION HEAD WITH LIFTING SUCTION DEVICES

[75] Inventors: Arno Wirz, Bammemtal; Peter Sobotta, Heidelberg, both of Fed. Rep. of Germany

[73] Assignee: Heidelberger Druckmaschinen AG, Heidelberg, Fed. Rep. of Germany

[21] Appl. No.: 176,709

[22] Filed: Apr. 1, 1988

[30] Foreign Application Priority Data

Apr. 1, 1987 [DE] Fed. Rep. of Germany ..... 3710994

[51] Int. Cl.[4] ..... B65H 3/08

[52] U.S. Cl. ..... 271/90; 271/5; 271/11; 271/103; 271/194; 271/93; 294/64.1; 294/65

[58] Field of Search ..... 271/5, 11–13, 271/20, 90–108, 42, 132, 194–197, 211, 283–284, 264, 276, 14–15, 309; 294/64.1–64.3, 65; 414/121; 198/689.1

[56] References Cited

U.S. PATENT DOCUMENTS

| | | | |
|---|---|---|---|
| 2,215,458 | 9/1940 | Backhouse | 271/103 X |
| 2,247,473 | 7/1941 | Binder | 271/103 |
| 2,903,290 | 9/1959 | Morris et al. | 294/65 |
| 2,941,799 | 6/1960 | Reincke | 271/92 |
| 2,950,913 | 8/1960 | Staines | 271/92 |
| 3,013,833 | 12/1961 | Gwin et al. | 294/65 |
| 3,048,391 | 8/1962 | Spiess | 271/90 |
| 3,219,377 | 11/1965 | Allen | 294/65 X |
| 3,866,764 | 2/1975 | Leiser | 271/106 X |
| 3,931,964 | 1/1976 | Schwebel | 271/93 |
| 4,327,906 | 5/1982 | Fröhlich et al. | 271/103 |
| 4,371,158 | 2/1983 | Marx et al. | 271/103 |
| 4,505,469 | 3/1985 | Kakimoto et al. | 271/103 X |
| 4,513,957 | 4/1985 | Schaefer, Jr. | 271/91 X |

FOREIGN PATENT DOCUMENTS

| | | | |
|---|---|---|---|
| 670638 | 1/1939 | Fed. Rep. of Germany . | |
| 925296 | 3/1955 | Fed. Rep. of Germany . | |
| 1005979 | 4/1957 | Fed. Rep. of Germany | 271/90 |
| 1098011 | 1/1961 | Fed. Rep. of Germany | 271/103 |
| 1109188 | 6/1961 | Fed. Rep. of Germany | 271/104 |

*Primary Examiner*—Douglas C. Butler

*Attorney, Agent, or Firm*—Herbert L. Lerner; Laurence A. Greenberg

[57] ABSTRACT

Suction head includes a vertically adjustable lifting suction device having a respective guiding element, and an axially displaceable, telescopically guided suction chamber arranged on the guiding element, the suction chamber having at least two suction nozzles disposed adjacent one another transversely to a direction in which sheets are conveyed, the suction nozzles being united into a double suction chamber so as to form a narrowly defined vacuum chamber.

6 Claims, 4 Drawing Sheets

SUCTION HEAD WITH LIFTING SUCTION DEVICES

The invention relates to a suction head with lifting suction devices.

Modern sheet-fed offset printing machines attain operating speeds of 12,000 to 15,000 prints per hour. When papers which are relatively well separable are fed into such sheet-fed printing machines, the suction heads in such machines can easily operate within this speed range without stops. Problems arise, however, the instant porous alpha papers, heavy cardboard or pasteboard or relatively thin label papers are to be separated from a pile thereof. Difficulties are caused especially by papers processed from a pallet. In such a case, suction heads with only two lifting suckers cannot keep up with the speed and are apt to cause stoppages because the sheet to be separated is lifted only at two locations, the precision of transfer to the conveying suckers suffering as a result.

To eliminate this deficiency, it has become known heretofore to attach four lifting suction devices to a common, vertically adjustable suction tube or pipe. Besides the conventional lifting suction devices provided on both sides of the suction head casing, a further lifting suction device is attached at each side, respectively, to the suction pipe. The lifting suction devices themselves are constructed as spring suction devices. All suction nozzles are set or adjusted so as to be spaced slightly from the top of the sheet pile. During correct or proper operation, the uppermost sheet is lifted from the pile due to the suction from the suction nozzles, and is pressed against the suction nozzles. By the closing of the suction nozzles a vacuum is produced in the spring suction devices and in the entire suction pipe which, after all four spring suckers have been completely closed, causes a lifting of the picked-up sheet against the spring, so that, immediately thereafter, carrying or supporting air can be blown under the lifted sheet. The sucking-up and separation of the respective uppermost sheet from the pile by the suction nozzles is supplemented by loosening blowers. After having lifted the respective uppermost sheet, the lifting suction devices transfer the sheet to the conveying suckers or suction devices which further convey or transport it in the direction of the first printing unit.

The four lifting suction devices of the suction head, when accurately adjusted, are usually able to separate the respective uppermost sheet from the pile within the above-indicated printing speed range without any stoppage. If one of the four lifting suction devices has been inaccurately adjusted, however, stoppages can occur because a vacuum is unable to be produced in the suction pipe. Besides, the entire space to be evacuated within the suction pipe and the four lifting suction devices is so large that a vacuum sufficient to trigger the springing up of the lifting suction devices is produced only with very great delay, especially when processing porous sheets. This time delay and the necessity to adjust and adapt all four suction devices precisely in relation to the uneven pile surface are time-consuming and at times, nevertheless, lead to pressure interruptions or breakdowns.

The fact that the two inwardly disposed suction nozzles are arranged relatively far away from one another constitutes a further problem with regard to the heretofore known suction heads. Therefore, the suction of the carrying air blown under the lifted sheet causes a sagging of the trailing sheet edge in this region so that the sheet, under certain conditions, is not transferred flat or level to the conveying suction devices, with a possible result that the sheet may become deformed during its further transport by the conveying means.

It is accordingly an object of the invention to provide a suction head which, at high operating speeds, processes all types of papers, and cardboards free of any trouble and transfers them accurately.

With the foregoing and other objects in view, there is provided, in accordance with the invention, a suction head comprising a vertically adjustable lifting suction device having a respective guiding element, and an axially displaceable, telescopically guided suction chamber arranged on the guiding element, the suction chamber having at least two suction nozzles disposed adjacent one another transversely to a direction in which sheets are conveyed, the suction nozzles being united into a double suction chamber so as to form a narrowly defined vacuum chamber.

In accordance with another feature of the invention, the suction nozzles are exchangeably attached.

In accordance with a further feature of the invention, the suction nozzles are arranged symmetrically to an axis of symmetry of the suction chamber.

In accordance with added feature of the invention, at least two suction nozzles are provided on a suction bar.

In accordance with an additional feature of the invention, the suction nozzles are formed with nipple suckers.

In accordance with again another feature of the invention, the suction head has two of the lifting suction devices, and each of the lifting suction devices has the two suction nozzles thereof united into a double sucker, a respective outwardly disposed suction nozzle of the double sucker being covered by a removable cap.

In accordance with again a further feature of the invention, the guide element has an axis of symmetry extending at an acute angle to the vertical.

In accordance with again an added feature of the invention, the lifting suction devices are constructed as spring suction devices.

In accordance with again an additional feature of the invention, the lifting suction devices are constructed as drop suction devices.

The suction nozzles of the lifting suction devices, as noted hereinbefore, are exchangeable so that the suction head can be rapidly adapted to the respective optimal requirements. For example, the processing of easily separable papers can be carried out with only two suction nozzles because the separating process is not subject to any difficulties.

Instead of two suction nozzles the double sucker of a lifting suction device may be provided with a continuous suction bar. Faulty sucking actions are effectively avoided by providing the suction nozzles and suction bar with nipple suckers which, particularly when porous papers are processed, additionally increase the suction effect of the two suction nozzles or of the suction bar. The small cup-shaped nippled suckers effect a rapid closing of the vacuum chamber with a slight amount of air.

Further advantage of the invention are the following: The movable parts of the lifting suckers, according to the invention, are of relatively small mass in structure and afford relatively quiet or smooth running at high conveying speeds.

The lifting suction devices are adjustable more rapidly than four single suckers, thereby economizing on preparation time.

The air passages in the suction chamber are short. The vacuum system is therefore subjected to slight inertia so that, in spite of a high conveying speed, the sheets are sucked-up reliably in the relatively short available time.

The middle region of the sheet edge is prevented from sagging as a result of the suction of the carrying or supporting air because, on the one hand, in equipping the two lifting suction devices with the double suckers according to the invention, the respective inner-lying suction nozzle is arranged closer to the middle than would be the case if the lifting suction devices were only equipped with conventional or normal suction nozzles and because, on the other hand, the two mutually adjacent suction nozzles of a double sucker according to the invention have a stabilizing effect upon the trailing sheet edge transversely to the sheet-conveying direction. Thus, the flat or level transfer of the lifted sheet to the conveying suckers or suction devices is assured.

Other features which are considered as characteristic for the invention are set forth in the appended claims.

Although the invention is illustrated and described herein as embodied in a suction head with lifting suction devices, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
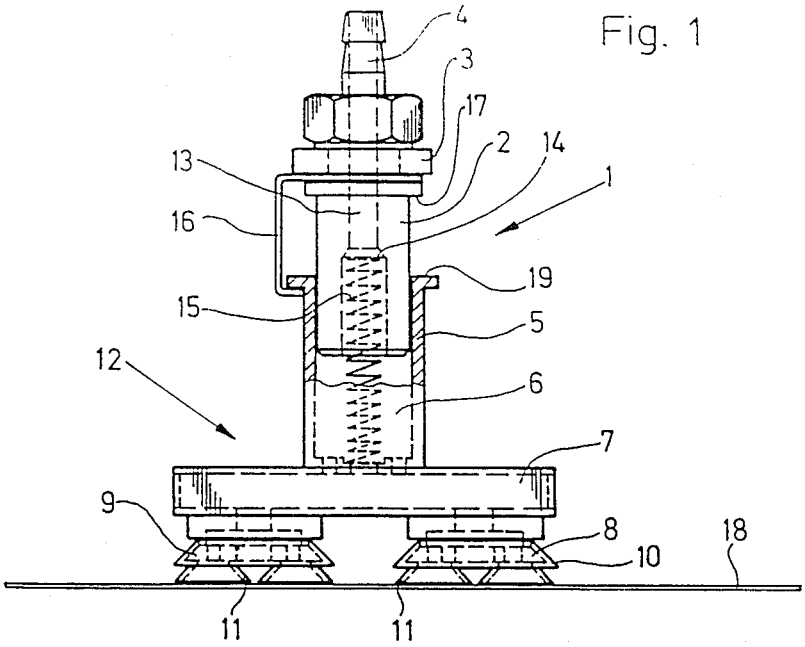
FIGS. 1, 2, 3 and 4 are diagrammatic views of different embodiments of lifting suction devices according to the invention, FIG. 3 being also a vertical sectional and FIGS. 1,2 and 4 being also front elevational views.

Referring now to the drawing and, first, particularly to FIG. 1 thereof, there is shown therein a lifting suction device 1 having a cylindrical guiding element 2 which is connected to movable and adjustable parts of an otherwise non-illustrated suction head by means of a holder 3. Above the holder 3 is a hose connection or union 4 to which a non-illustrated hose leading to a non-illustrated compressor is attachable. A guided cylinder 5 of a suction chamber 6 slides on the cylindrical surface of the guiding element 2.

The suction chamber 6 is formed of the aforementioned guided cylinder 5, a transverse tube 7 and two suction nozzles 8 and 9 fastened to the transverse tube 7. Rubber rings 10 provided with nipple suckers 11 are clamped onto the suction nozzles 8 and 9. The suction chamber 6 and the suction nozzles 8 and 9 together form a vertically movable double sucker 12.

Within the guiding element 2, a centrally disposed borehole 13 serving as an air channel is formed with a shoulder 14 against which an upper end of a spring 15 abuts. The lower end of the spring 15 rests on the transverse tube 7 so that the spring 15 thereby continuously biases the double sucker 12 into a lower operating position. The downward length of stroke is limited by a flexible or resilient limiting holder 16 which is received at one end thereof in an annular groove formed in the guiding element 2 and which engages at the other end thereof around a rim 19 formed at an end of the guided cylinder 5. By withdrawing this limiting holder 16 from the annular groove of the guiding element 2, the double sucker 12 can be slipped off the guiding element 2 of the lifting suction device 1 and be replaced by a conventional or normal suction nozzle part. The length of stroke upwardly is limited by a shoulder 17. In the illustrated operating position of FIG. 1, the double sucker 12 of the lifting suction device 1 is in its lower operating position, the nipple suckers 11 of the suction nozzles 8 and 9 being, in fact, tightly closed by a sheet 18 which has just been sucked up. A vacuum is then rapidly produced in the suction chamber 6 so that the double sucker 12 is sucked upwardly in vertical direction until the annular end surface at the rim 19 of the guided cylinder 5 abuts the shoulder 17. In this position of the double sucker 12, the sheet 18 has reached an upper height at which it can be taken over by non-illustrated conventional conveying suction devices. During this take-over process, air is fed to the evacuated suction chamber 6 so that the vacuum breaks down and the sheet 18 is freed from the nipple suckers 11. Thereafter, the spring 15 biases the double sucker 12 again into the position thereof shown in Fig.1.

Figure 2:
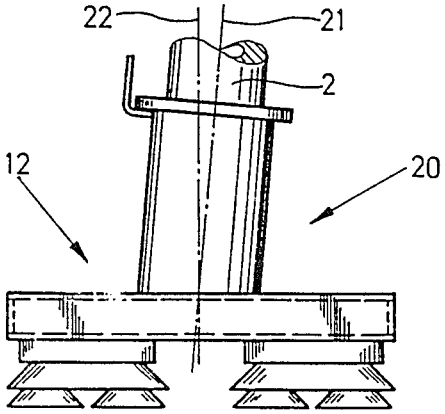

FIG. 2 shows a lifting suction device 20, according to the invention, which differs from the suction device 1 of FIG. 1 merely in that the axis of symmetry 21 of the guiding element 2 extends at a small acute angle with respect to the vertical 22. This outwardly slanted arrangement of the guiding element 2 effects a slight outward movement of the double sucker 12 away from the suction head during an upward movement of the double sucker 12 so that, when the sheet 18 is lifted, the middle part of the sucked-up sheet 18 which is especially exposed to the suction of the carrying air is additionally subjected to tension. As a rule, this measure is not necessary because the mutually closely adjacent suction nozzles 8 and 9 of a double sucker 12 already have a stabilizing effect upon the sheet and, moreover, because the suction nozzle 9 is disposed closer to the middle of the sheet than would be the case if the lifting suction device 1 or 20 were equipped only with a conventional or normal suction nozzle.

Figure 3:
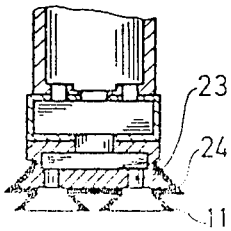
Figure 4:
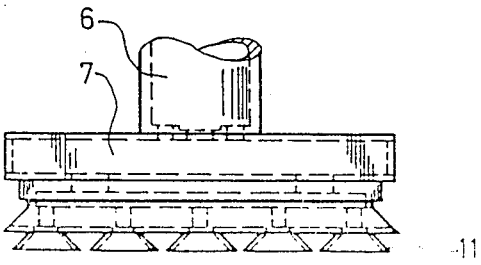

As illustrated in FIGS. 3 and 4, the transverse tube 7 of the suction chamber 6 can be constructed with a mounting 23 for a suction bar 24 made of rubber at the underside thereof. This suction bar 24 is likewise equipped with nipple suckers 11. The construction of the suction chamber 6 is not different basically from that provided for the two suction nozzles 8 and 9. The advantage of the suction bar 24 is merely that it can be put on or mounted somewhat faster than the two rubber caps 10 of the suction nozzles 8 and 9. Moreover, several suction nipples suck simultaneously (for example, 10).

Figure 5:
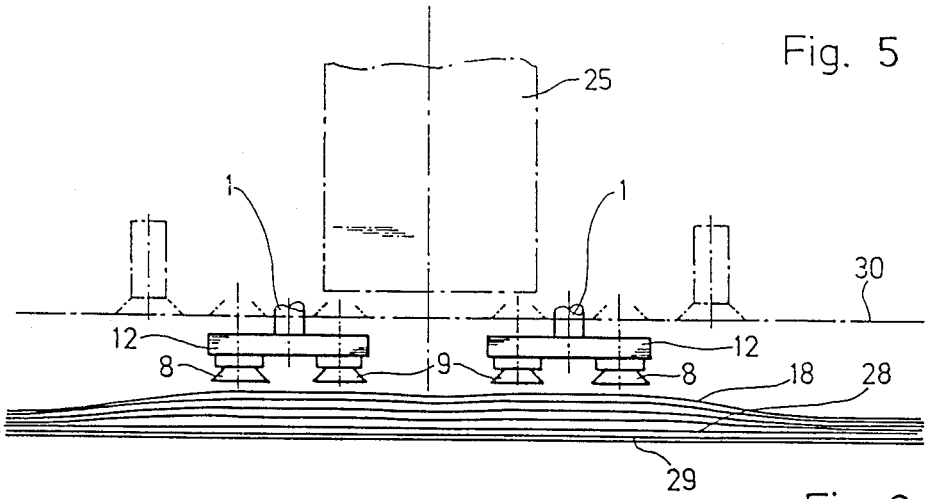
FIGS. 5 and 6 are reduced, fragmentary and highly diagrammatic front elevational and top plan views of an embodiment of the invention showing the manner of operation of the lifting suction devices according to the invention.
Figure 6:
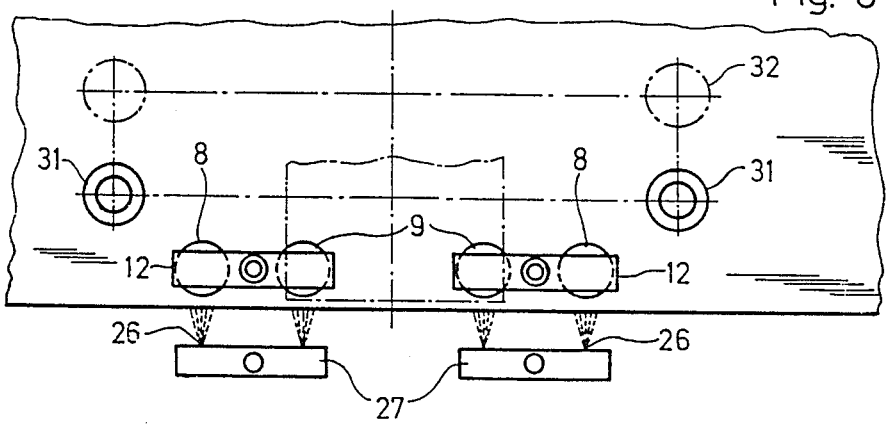
Figure 7:
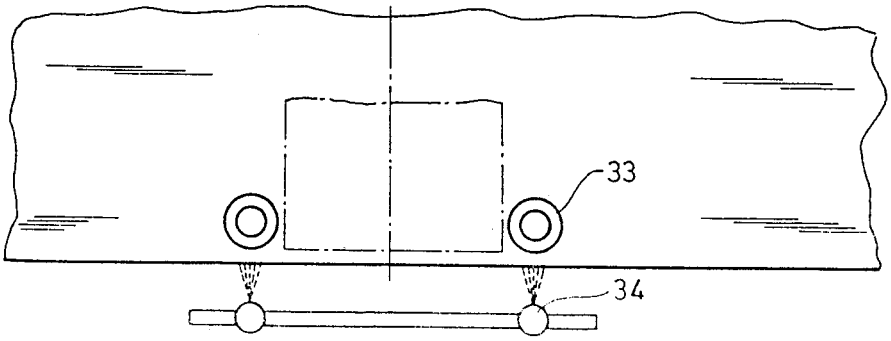
FIG. 7 is a view similar to that of FIG. 6 of another embodiment of the invention showing the manner of operation of the lifting suction devices.

In FIGS. 5, 6 and 7, a conventional suction head 25 is shown diagrammatically in phantom with control and drive means which actuate the two lifting suction devices 1 in accordance wit the object of the invention. FIG. 5 shows the double suckers 12 of the lifting suction device 1 in the lowest position thereof. As can be seen from FIG. 6, loosening air is blown out of nozzles 26 of two box-shaped loosening blowers 27 at the height of each suction nozzle 8, 9 of the double sucker 12, thereby loosening the uppermost sheets 28 of the stack 29, as can be seen from FIG. 5. The instant the lifting suction devices 1 and 2 are supplied with suction air, the uppermost sheet 18 is sucked up by the suction nozzles 8 and 9 of the double sucker 12. This position is illustrated in FIG. 1. After the suction nozzles 8 and 9 of each double sucker 12 have been closed, a vacuum is quickly produced due to the relatively short air passages in the suction chamber 6 of the double sucker 12, the vacuum lifting the double suckers 12 into the upper position thereof shown in phantom. The sheet 18 is then located at the level or height of the dot-dash line 30. Two conveying suckers 31 take over the sheet in the drawn-out position, whereupon the suction nozzles 8 and 9, as aforedescribed, are supplied with air, and release the sheet 18. The conveying suckers 31 convey or transport the picked-up sheet 18 to a position 32 thereof shown in phantom.

If easily separable sheets are processed at high speed, the double suckers 12 can be exchanged very quickly for single suckers 33. In this regard, the box-shaped loosening blowers 27 are replaced by tubular loosening blowers 34.

Figure 8:
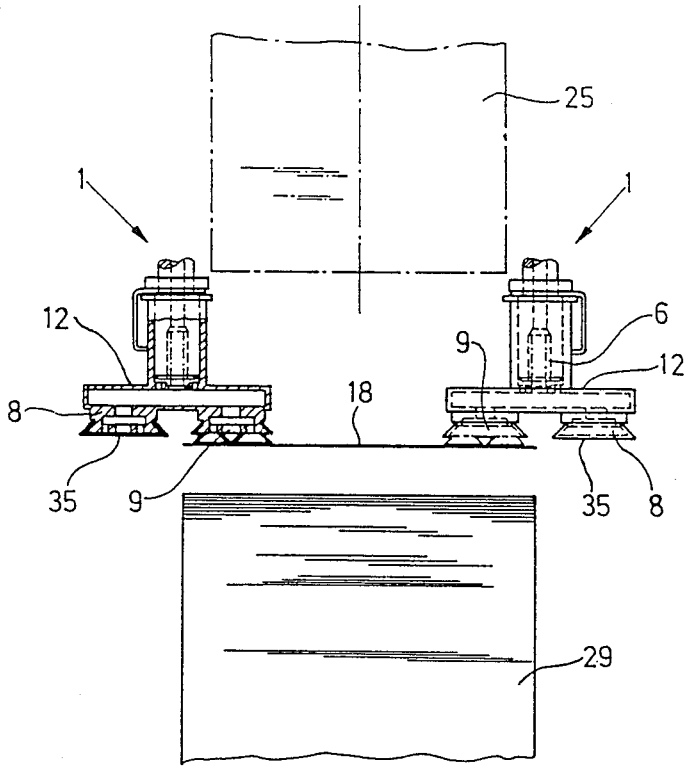
FIG. 8 is a vertical sectional view of embodiments similar to that of FIG. 1 showing the construction of lifting suction devices according to the invention used for processing small formats.

If such small sheet formats are to be processed by the suction head 25 that the outer suction nozzles 8 would not be covered by the sucked-up sheet 18, the suction nozzle 8 of each double sucker 12 can be closed by a cap 35, as shown in FIG. 8. Because the suction nozzles 8 and 9 are arranged symmetrically to the suction chamber 6 of the double sucker 12, the entire vacuum system behaves in a way exactly as if the suction nozzles 8 were also covered by the sheet 18, when only the suction nozzles 9 of both double suckers 12 are covered and closed by the sheet 18. A vacuum is produced very quickly and symmetrically, and the double suckers 12 spring upwardly into the upper position thereof in order to lift the sheet 18 with the small format into the transfer position. Of course, in such a case, the conveying suckers 26 must be positioned closer to one another than indicated in FIG. 6. The advantage of this embodiment of the invention is that even such sheet formats are yet processable which could not be picked up any more if the lifting sucker 1 were equipped with conventional or normal single suction nozzles.

Figure 9:
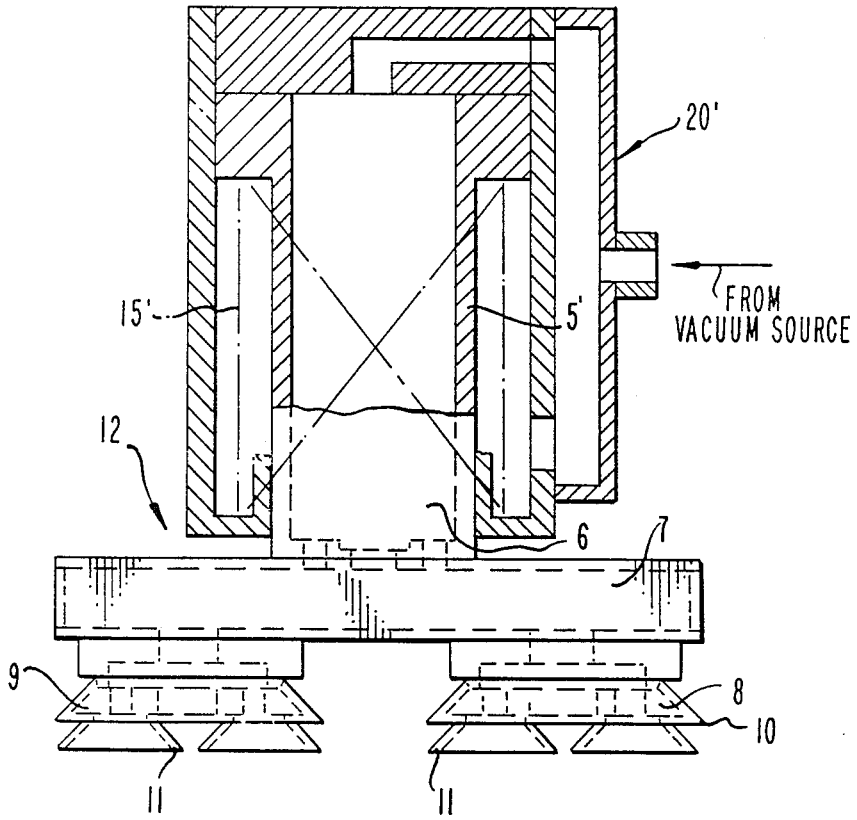
FIG. 9 represents a lifting suction device of the drop suction type has been added.

FIG. 9 discloses a lifting suction device 20' of the drop suction type. FIG. 9 is basically a combination of the invention of instant FIG. 1 and a conventional drop suction device with the vacuum source (not shown) has been added.

Of course, as hereinaforementioned, the invention is not limited to the embodiments illustrated herein; for example, the vertically movable part of the lifting suction device 1 can also be constructed as a triple sucker provided with three suction nozzles. Also, the lifting suction devices can be constructed as drop suction devices wherein the double sucker is driven downwardly onto the surface of the sheet pile by vacuum. It is especially advantageous to form the movable parts of plastic or light metal which then affords the construction of light-weight and relatively inexpensive double lifting suction devices having a very fast reduction and leaping movement.

We claim:

1. Suction head comprising vertically adjustable lifting suction device having a respective guiding element, and an axially displaceable, telescopically guided structure arranged on said guiding element, said structure being formed of a guided cylinder and a tube transverse thereto and having at least two suction nozzles exchangeably attached to said transversely tube and disposed adjacent one another transversely to a direction in which sheets are conveyed, said suction nozzles being united into double nipple suckers connected to one another by said transverse tube, said transverse tube being a suction bar and forming with said guided cylinder a narrowly defined substantially T-shaped suction chamber.

2. Suction head according to claim 1, wherein said suction nozzles are arranged symmetrically to an axis of symmetry of said suction chamber.

3. Suction head according to claim 1, having two of said lifting suction devices, each of said lifting suction devices having said two suction nozzles thereof united into a double sucker, a respective outwardly disposed suction nozzle of said double sucker being covered by a removable cap.

4. Suction head according to claim 1, wherein said guiding element has an axis of symmetry extending at an acute angle to the vertical.

5. Suction head according to claim 1, wherein said lifting suction devices are constructed as spring suction devices.

6. Suction head according to claim 1, wherein said lifting suction devices are constructed as drop suction devices.

* * * * *